US009322539B2

(12) United States Patent
Baldwin

(10) Patent No.: US 9,322,539 B2
(45) Date of Patent: Apr. 26, 2016

(54) CORDLESS SPIKE LIGHT AND LAMPHOLDER SOCKET

(71) Applicant: Jeffrey Philip Baldwin, Desert Hills, AZ (US)

(72) Inventor: Jeffrey Philip Baldwin, Desert Hills, AZ (US)

(73) Assignee: Hubbell Incorporated, Shelton, CT (US)

( * ) Notice: Subject to any disclaimer, the term of this patent is extended or adjusted under 35 U.S.C. 154(b) by 216 days.

(21) Appl. No.: 14/137,450

(22) Filed: Dec. 20, 2013

(65) Prior Publication Data

US 2014/0293621 A1 Oct. 2, 2014

Related U.S. Application Data

(60) Provisional application No. 61/745,280, filed on Dec. 21, 2012.

(51) Int. Cl.

| | |
|---|---|
| ***F21V 23/06*** | (2006.01) |
| ***F21V 21/08*** | (2006.01) |
| ***F21V 31/00*** | (2006.01) |
| ***F21S 6/00*** | (2006.01) |

(52) U.S. Cl.

CPC ..... *F21V 23/06* (2013.01); *F21S 6/005* (2013.01); *F21V 21/0824* (2013.01); *F21V 31/005* (2013.01)

(58) Field of Classification Search

CPC ... F21V 23/06; F21V 31/005; F21V 21/0824; F21S 6/005

See application file for complete search history.

(56) References Cited

U.S. PATENT DOCUMENTS

| | | | | |
|---|---|---|---|---|
| 5,257,172 | A * | 10/1993 | Erickson | F21L 14/02 362/457 |
| 5,386,356 | A | 1/1995 | Davis, Jr. et al. | |
| 5,506,761 | A | 4/1996 | Strauss | |
| 6,585,393 | B1 * | 7/2003 | Brandes | A47F 3/001 362/219 |
| 7,137,721 | B1 | 11/2006 | Rao et al. | |
| 2004/0221883 | A1 | 11/2004 | Nipke | |
| 2006/0198153 | A1 | 9/2006 | Chien | |
| 2007/0171655 | A1 | 7/2007 | Lai | |
| 2008/0084711 | A1 | 4/2008 | Chen | |
| 2010/0265715 | A1 * | 10/2010 | Winstanley | F21S 2/00 362/277 |

OTHER PUBLICATIONS

U.S. Appl. No. 12/832,509, filed Jul. 8, 2010, abandoned, available at U.S. Patent and Trademark Office website.

* cited by examiner

*Primary Examiner* — David V Bruce
(74) *Attorney, Agent, or Firm* — Dickinson Wright PLLC

(57) ABSTRACT

An outdoor light fixture includes a housing and a socket. The housing has a first opening, a second opening, and a shroud extending at least partially around the second opening. A locating ring is positioned between the first opening and the second opening. The socket is located in the housing and has an insulator and a skirt. The skirt positions the socket relative to the locating ring.

20 Claims, 11 Drawing Sheets

CORDLESS SPIKE LIGHT AND LAMPHOLDER SOCKET

CLAIM TO PRIORITY

This application is based on provisional application Ser. No. 61/745,280, filed Dec. 21, 2012, the disclosure of which is incorporated herein by reference and to which priority is claimed.

FIELD OF THE INVENTION

Aspects and implementations of this document relate generally to light fixtures. Particular implementations include light fixtures without a cord that reduce the risk of tripping a ground fault or electrocution.

BACKGROUND

Light fixtures of various forms are well known in the electrical lighting art. Traditional light fixtures designed for halogen bulbs consist of a grounded bulb mount adapted to receive the halogen bulb and a reflector within the light fixture. A cord extends from the back of the fixture and may include a three-wire electrical plug for connecting to an electrical cord extension. The cord lengths vary from a few inches to several feet in length. Regardless, when used as a spike light, with the light fixture only slightly off the ground, the cord will ultimately rest on the ground if an electrical cord extension is required. Further, the cord and electrical cord extension faces are both exposed to the elements creating the possibility of a ground fault or electrocution from water or rain.

SUMMARY

In accordance with an embodiment, an outdoor light fixture includes a housing and a socket. The housing has a first opening, a second opening, and a shroud extending at least partially around the second opening. A locating ring is positioned between the first opening and the second opening. The socket is located in the housing and has an insulator and a skirt. The skirt positions the socket relative to the locating ring.

In accordance with another embodiment an outdoor light fixture includes a socket and a housing. The socket has an insulator and a skirt. The skirt includes a mounting boss. The housing has a first opening, a second opening, and a shroud extending at least partially around the second opening. The housing also includes a depression at least partially receiving the mounting boss.

In accordance with another embodiment, an outdoor light fixture includes a housing, a socket, and a gasket. The housing has a first opening, a second opening, and a shroud extending at least partially around the second opening. A locating ring is positioned between the first opening and the second opening. The socket is located in the housing and has an insulator, a skirt, and a gasket slot. The gasket is positioned in the gasket slot forming a seal between the socket and the housing.

Other embodiments, including apparatus, systems, methods, and the like which constitute part of the invention, will become more apparent upon reading the following detailed description of the exemplary embodiments and viewing the drawings. It is to be understood that both the foregoing general description and the following detailed description are exemplary and explanatory only and therefore not restrictive.

BRIEF DESCRIPTION OF THE DRAWINGS

The accompanying drawings are incorporated in and constitute a part of the specification. In such drawings.

DETAILED DESCRIPTION OF EXEMPLARY EMBODIMENT(S) AND EXEMPLARY METHOD(S)

Figure 1:
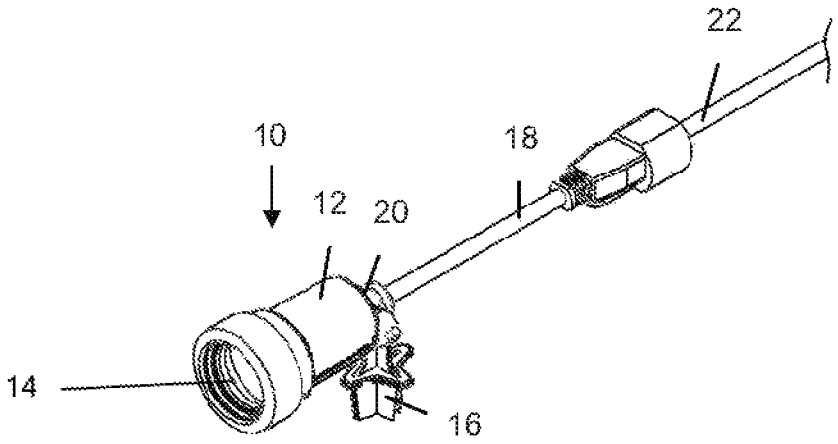
FIG. 1 (PRIOR ART)
FIG. 1 is a perspective view of a prior art light fixture inserted into the ground.

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

FIG. 1 illustrates a prior art light fixture 10 with a body 12 having a light source opening 14 and a spike 16. The spike 16 may be rotatably secured to a rear portion of the body 12 to allow the owner to focus the light on a particular area. An electrical cord 18 extends from a back end 20 of the body 12 and is arranged to connect to an electrical cord extension 22.

When the light fixture 10 is connected to an electrical cord extension 22 and the spike mounted in the ground, the connection between the electrical cord extension 22 and the electrical cord 18 is exposed to the atmosphere. Because the connection is exposed, water, precipitation, and debris may enter the connection. Moreover, the cord 18 may be flexible and rest on the ground during operation, creating a hazard if water puddles and the connection between the cord 18 and the extension 22 is resting within the puddle.

Figure 2:
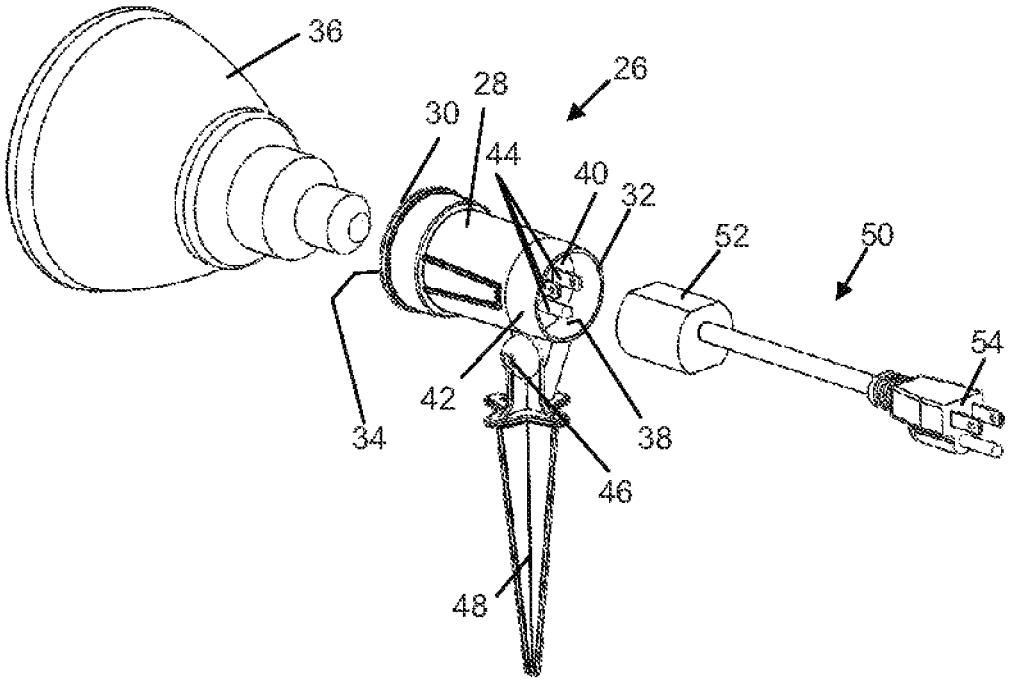
FIG. 2 is a perspective assembly view of a light fixture according to an exemplary embodiment of the invention.
Figure 3:
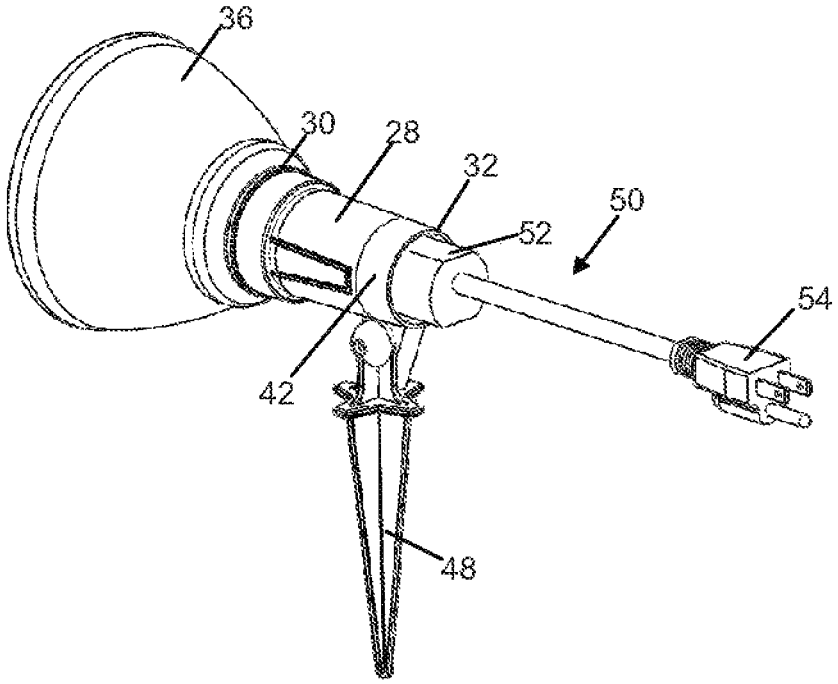
FIG. 3 is a perspective view of the light fixture of FIG. 2 with the light bulb and the extension cord attached.
Figure 4:
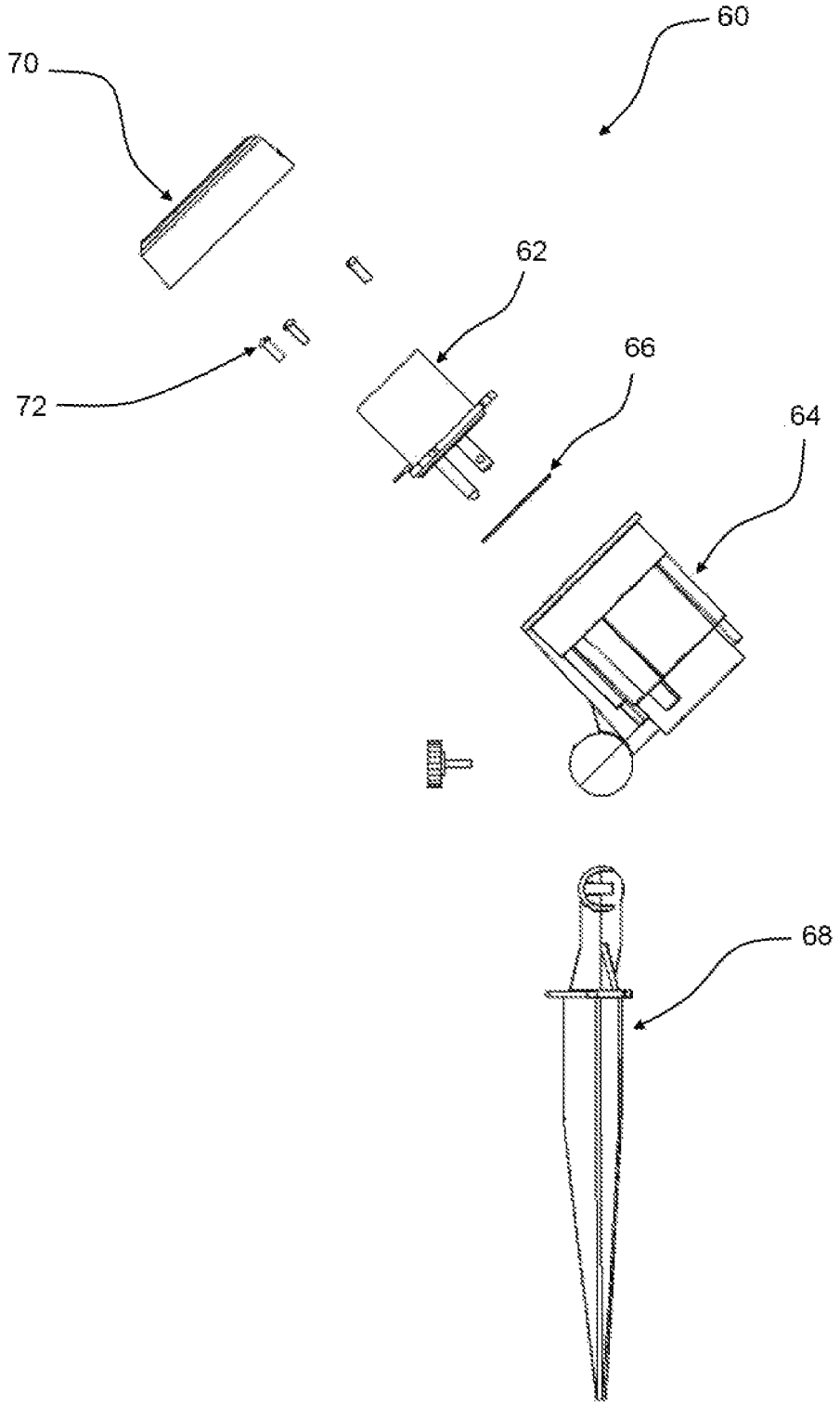
FIG. 4 is a perspective, exploded view of a light fixture according to another exemplary embodiment.

Referring now to FIGS. 2 and 3, a particular embodiment of the light fixture 26 includes a body 28 having a front end 30 and a back end 32 which may be directly opposite the front end and coaxially aligned with and/or diametrically opposed to the front end. The front end 30 includes a light source opening 34 arranged to receive a light source 36. The light source 36 may be a screw-in or snap-in, or any other suitable type of electrical lighting bulb or lamp. The light source opening 34 may also be tapered to accommodate light sources 36 of various sizes. While the body 28 is shown as substantially cylindrical in shape, any suitable shape may be incorporated.

The back end 32 includes a rear opening 38 having a rear wall 40 defining the rear portion of the rear opening 38. A shroud 42 extends outwardly from rear wall 40 and may be formed integral with or as a separate component from the body 28. Still further, an electrical cord connector 44 extends into rear opening 38 through the rear wall 40 and is contained within the rear opening 38.

The body 28 also includes a pivot mount 46 connected to a spike 48. The spike 48 is inserted within the ground and permits the body 28 to be pivoted about the mount 46 to provide precise positioning of the light fixture 26.

An electrical cord extension 50 may include a socket (or female connector) 52 and a plug (or male connector) 54. In one particular embodiment, the body 28 includes a cord connector 44 with a plug or male connector within rear opening 38, and a socket or female connector 52 of the electrical cord extension 50 is connected to the light fixture 26 to provide electricity for illumination. In another particular embodiment (not shown), the body 28 may include a cord connector 44 with a socket or female connector within the rear opening 38 and a plug or male connector 54 of the electrical cord extension 50 is connected to the light fixture 26 to provide electricity for illumination. In this second particular embodiment, the electrical cord extension preferably includes a plug on each end to allow the cord to be plugged into a standard outlet.

While the particular embodiments have been shown and described using a NEMA 5-15 (North American 15A/125V grounded) connector, the rear opening 38 may be sized and shaped to fit any electrical connector. Specifically, the rear opening 38 is sized just slightly larger and has a depth sufficient that a face of the electrical cord extension plug (meaning the mounting face where the extension plug connects to the cord connector 44) will be wholly contained within the rear opening 38.

FIG. 3 illustrates the light fixture 26 with the electrical cord extension 50 fully inserted within the rear opening 38 and the light source 36 fully seated within the light source opening 34. The light fixture 26 can only be inserted within the ground up to the distance of the spike and the plug end 54 and the socket end 52 are thus both maintained above the ground during operation. This arrangement greatly reduces the risk of an electrical cable socket or plug from being submerged in a water puddle formed on the ground during operation. Still further, the socket face is wholly maintained within the rear opening 38 during operation, once again greatly reducing the possibility of water contacting the socket or plug faces and causing an electrical short.

Accordingly, the light fixture reduces the likelihood of a ground fault by providing light fixture 26 with body 28 having opening 34 for receivably securing light source 36, and opening 38 located within body 28 and separate from opening 34. Next, electrical extension cord 50 is inserted within opening 38 so that the front face is completely located within opening 38 and above the ground or mounting surface.

FIGS. 4-16 depict an exemplary embodiment of a light fixture 60 having a socket 62, a housing 64, a gasket 66, a base 68, and a bulb gasket 70. The socket 62 is connected to the housing 64 by mounting fasteners 72. The socket 62 receives a light source 74 and connects to an electrical extension cord 76. The light source 74 may be a screw-in or snap-in, or any other suitable type of electrical lighting bulb or lamp. Similar to the embodiments discussed above, the base 68 may be inserted into the ground to support the housing 64 so that the light fixture 60 and the connection to the extension cord 76 are above the surface of the ground.

Figure 5:
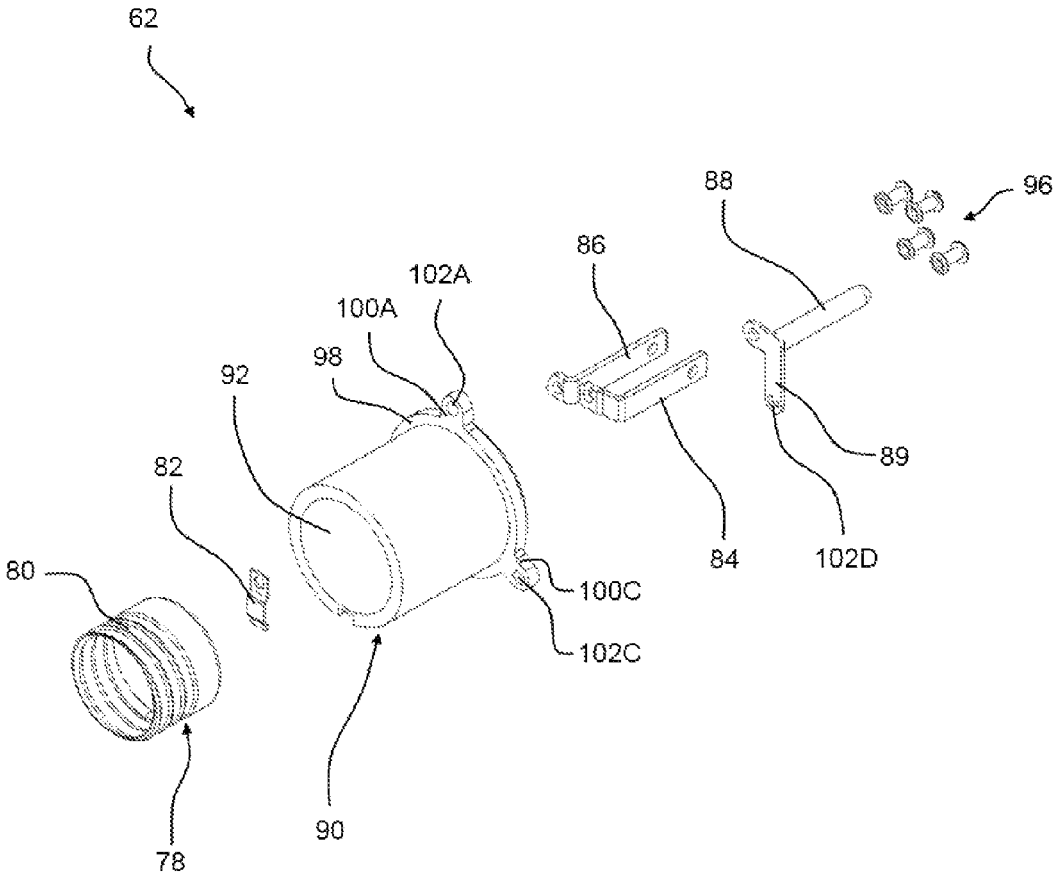
FIG. 5 is a perspective, exploded view of the socket shown in FIG. 4.

As best shown in FIG. 5, the socket 62 includes a screw shell 78 located inside an insulator 90. The screw shell 78 is configured to mechanically receive and electrically connect to a light source 74. The screw shell 78 includes a set of threads 80 for threadably receiving a light bulb 74. The screw shell 78 is made from a conductive material such as metal. In various exemplary embodiments, the size and shape of screw shell 78 may be configured to receive different types of light bulbs. The screw shell 78 may also be replaced with another form of light bulb connector as would be understood by one of ordinary skill in the art.

The socket 62 also includes a brush 82 configured to electrically contact the center contact on the light source 74 and a set of prongs including a hot prong 84, a neutral prong 86, and a ground prong 88. The hot 84, neutral 86, and ground prongs 88 may be plugged into a hot orifice, a neutral orifice, and a ground orifice, respectively, of the receptacle end of an extension cord 76. In an exemplary embodiment, the hot prong 84 is electrically coupled to the brush 82, the neutral prong 86 is electrically coupled to the screw shell 78, and the ground prong 88 is electrically coupled to a grounding tab 89 that is to be electrically coupled to the housing 64. Various embodiments may omit the ground prong 88 and grounding tab 89.

Figure 6:
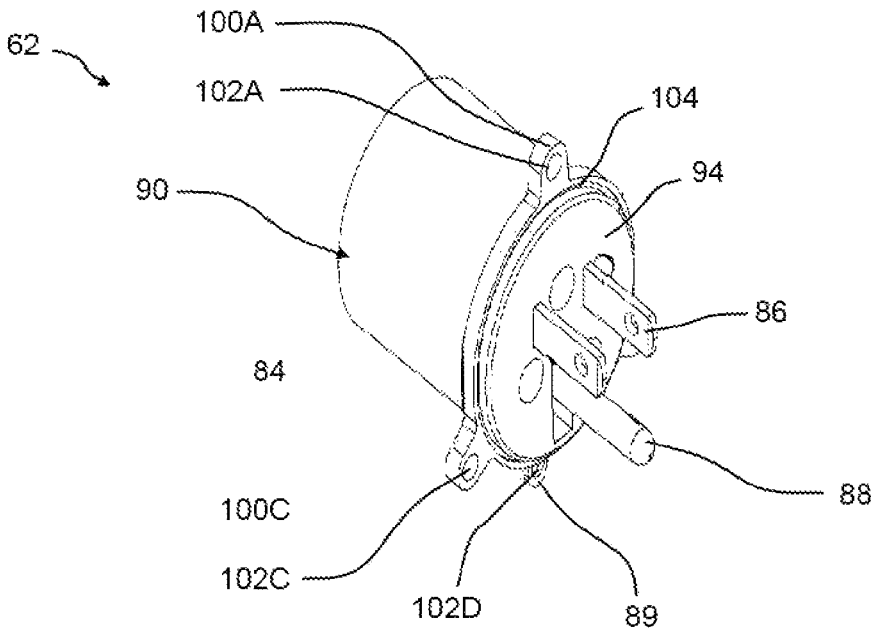
FIG. 6 is a front, perspective view of the socket shown in FIG. 5.
Figure 7:
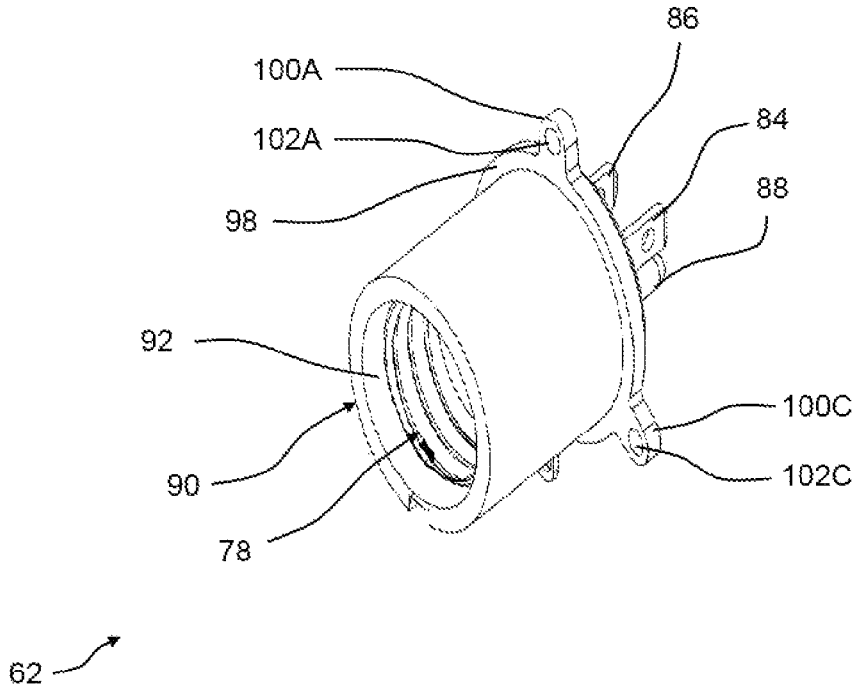
FIG. 7 is a rear, perspective view of the socket shown in FIG. 5.
Figure 8:
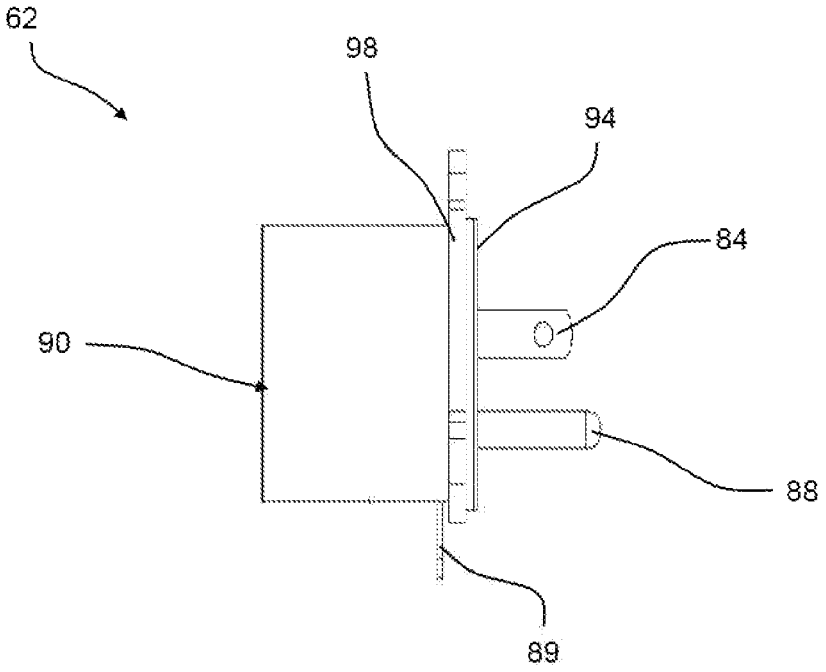
FIG. 8 is a side view of the socket shown in FIG. 5.
Figure 9:
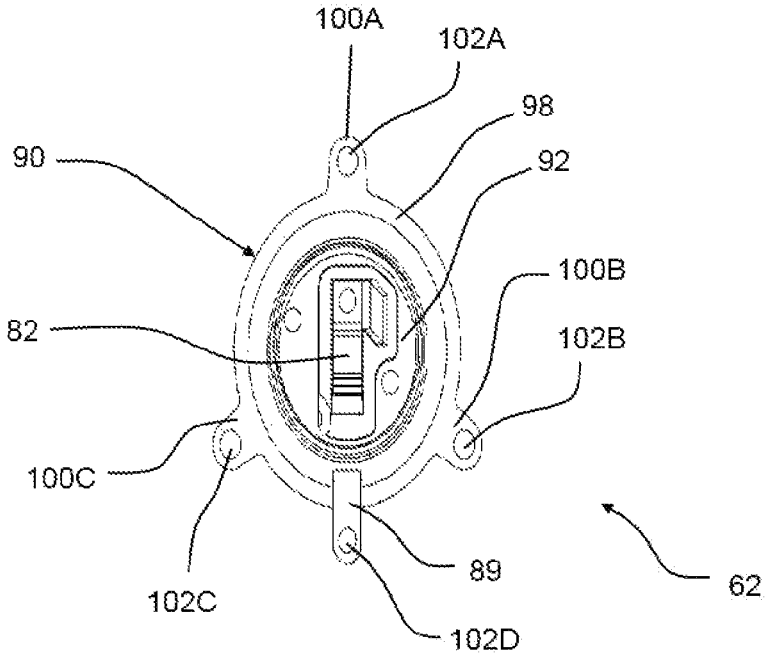
FIG. 9 is a front view of the socket shown in FIG. 5.

As best shown in FIGS. 5-7, the socket 62 includes an insulator 90 having an opening 92 and an end wall 94. The insulator 90 provides structure for the socket 62 and has a substantially hollow-cylindrical shape. The opening 92 receives the screw shell 78. The end wall 94 has a set of apertures allowing the prongs 84, 86, 88 to pass therethrough. The prongs 84, 86, 88 and the brush 82 are connected to the end wall 94 through a set of fasteners 96, although other suitable mechanical or adhesive connections may be used. As best shown in FIG. 9, the inner surface of the end wall 94 may include a depression for receiving at least a portion of the brush 82.

Figure 10:
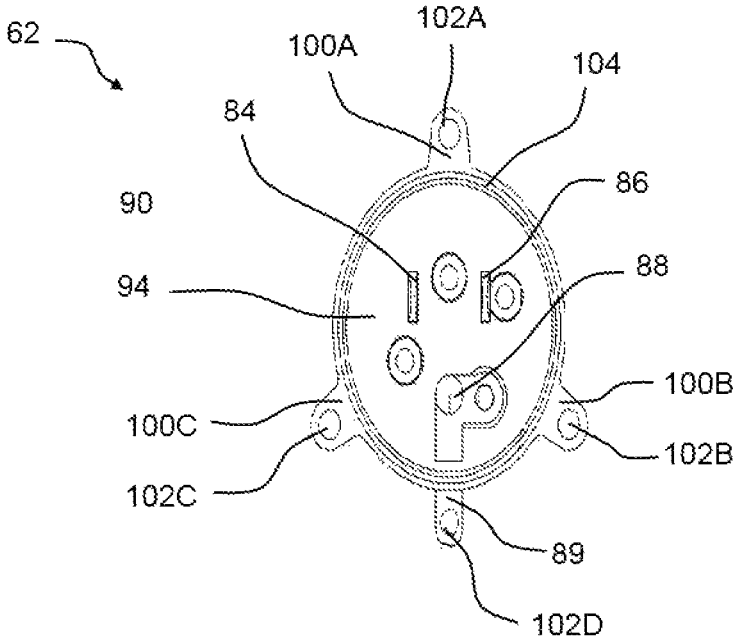
FIG. 10 is a rear view of the socket shown in FIG. 5.

The socket 62 also includes a skirt 98 surrounding at least a portion of the insulator 90. The skirt 98 may be integral with the insulator or separately formed and attached mechanical or via adhesive. In various exemplary embodiments, the end wall 94 is axially offset from the skirt 98. The skirt 98 includes at least one mounting boss 100A extending from the skirt 98, with the present exemplary embodiment having three mounting bosses 100A, 100B, 100C. Each mounting boss 100A-C includes a mounting aperture 102A-C for receiving a mounting fastener 72 to connect the socket 62 to the housing 64. As best shown in FIGS. 9 and 10, the grounding tab 89 may also include a mounting aperture 102D. The mounting fasteners 72 provide not only mechanical coupling, but also electrical coupling or continuity to the housing 64. The mounting fasteners 72 may be threaded fasteners, and the mounting apertures 102A-C may include corresponding threads.

The skirt 98 includes a gasket slot 104 to receive a gasket 66, for example an O-ring to be positioned between the socket 62 and the housing 64. The gasket slot 104 is depicted as an annular ring, although the size, shape, and depth of the gasket slot 104 may vary depending on the type of socket 62, housing 64, or gasket 66. Various alternative embodiments may not utilize the gasket slot 104, and the gasket 66 may rest against a face of the skirt 98.

FIGS. 11-15 depict an exemplary housing 64 having a bulb receiving end 106 with a first opening 108 for receiving the socket 62. A lip 110 or other raised portion may surround the first opening 108. The housing 64 also includes a shroud 112 extending at least partially around a second opening 114. The housing has a substantially hollow-cylindrical shape and may be made from a metal, polymer, ceramic, or a composite material. As depicted, the housing 64 tapers from the first opening 108 to the second opening 114, and the first opening 108 has a diameter larger than the diameter of the second opening 114. In alternative embodiments, the shape of the housing 64 and the sizes of the first and second openings 108, 114 may vary.

Figure 11:
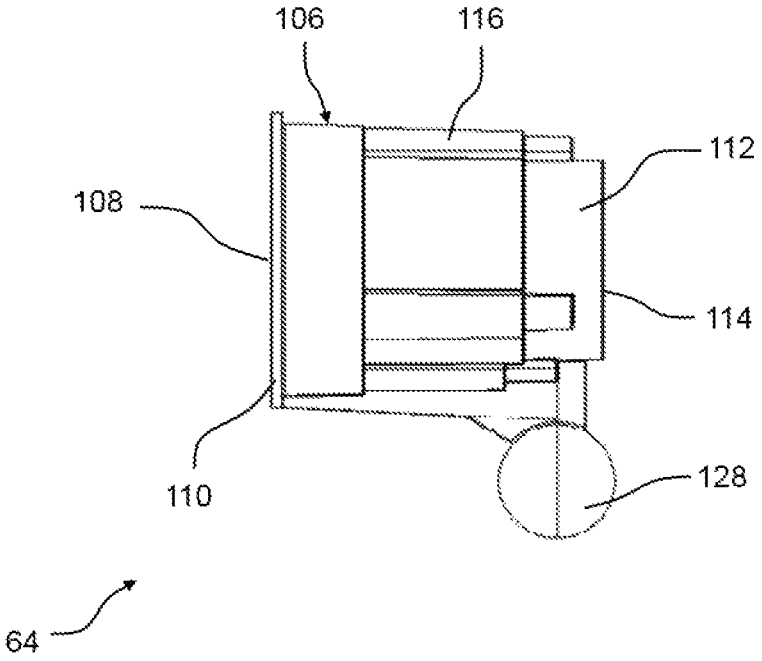
FIG. 11 is a side view of the housing shown in FIG. 4.

As best shown in FIG. 11, the housing 64 may also include a series of ribs 116 extending axially along the housing 64 and radially above a main surface of the housing 64. The ribs 116 provide additional support to the housing and space to receive the mounting bosses 100 of the skirt 98.

The housing 64 includes a locating ring 118 positioned between the first opening 108 and the second opening 114. The housing also includes one or more depressions 120A, with the exemplary embodiment having three depressions 120A, 120B, 120C. The depressions 120A-C each receive a respective mounting boss 100A-C. The locating ring 118 includes one or more ring apertures 122A, with the exemplary embodiment having three ring apertures 122A, 122B, 122C aligned with the depressions 120A-C. The depressions 120A-C and ring apertures 112A-C may be coaxial. The ring apertures 122A-C receive mounting fasteners 72 to secure the socket 62 to the housing 64. The mounting fasteners 72 may be threaded fasteners, and the ring apertures 122A-C may include corresponding threads. In various exemplary embodiments, the number of depressions 120A-C equals the number of mounting bosses 100A-C. The housing 64 also includes a ground aperture 124 for receiving a mounting fastener from the grounding tab 89 and for electrically connecting the housing 64 with the grounding tab 89.

Figure 12:
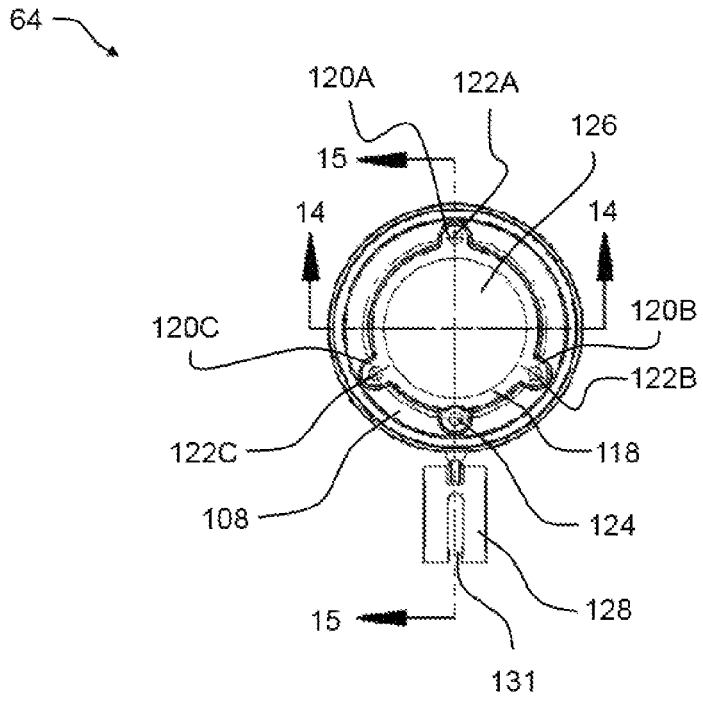
FIG. 12 is a front view of the housing shown in FIG. 11.
Figure 13:
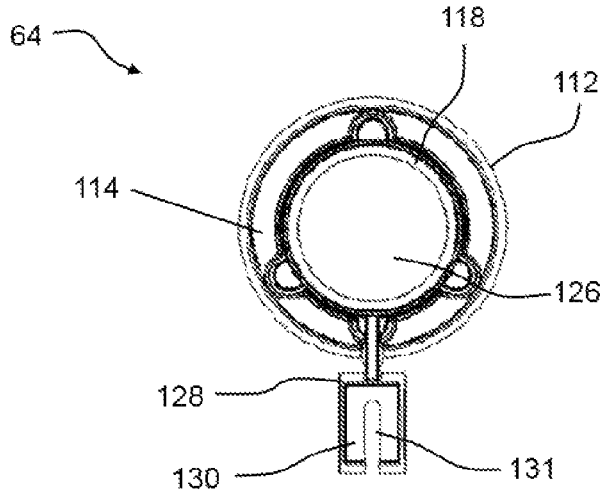
FIG. 13 is a rear view of the housing shown in FIG. 11.
Figure 14:
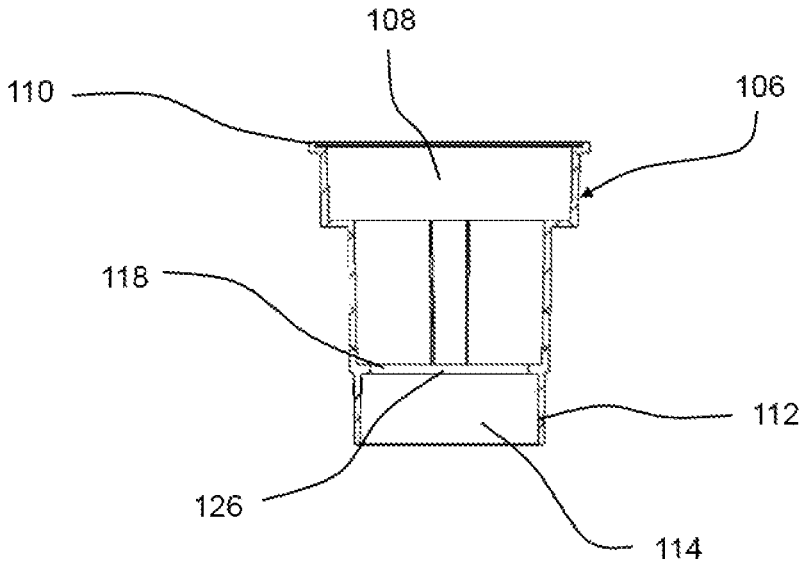
FIG. 14 is sectional view of the housing shown in FIG. 12 taken along line 14-14.
Figure 15:
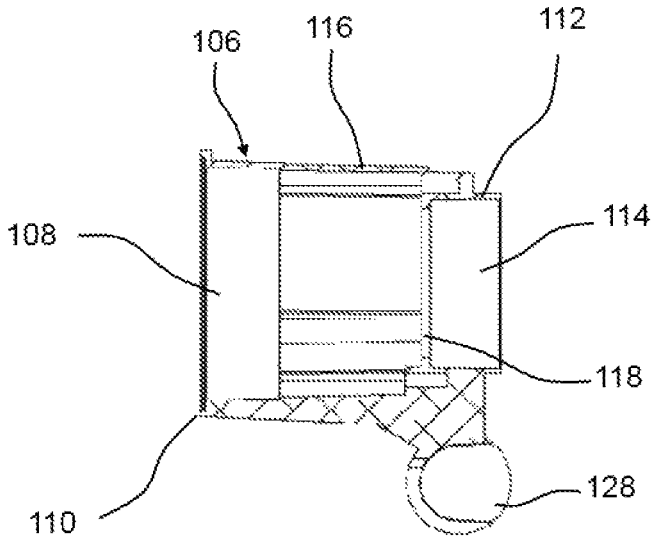
FIG. 15 is a section view of the housing shown in FIG. 12 taken along line 15-15.

As best shown in FIGS. 12-15, the locating ring extends from a bottom surface of the housing 64 to define a central passageway 126 having a diameter less than the diameter of the first and second openings 108, 114. The locating ring 118 assists in properly positioning the socket 62 in the housing 64 and also provides a surface to receive the gasket 66. As best shown in FIGS. 14 and 15, the locating ring is positioned adjacent the shroud 112; however, it may be positioned at any axial location along the housing 64. When the socket 62 is connected to the housing 64, the insulator 90 end wall 94 is positioned in or extending through the central passageway 126 and the ground prongs 84, 86, 88 extend into the second opening 114.

Figure 16:
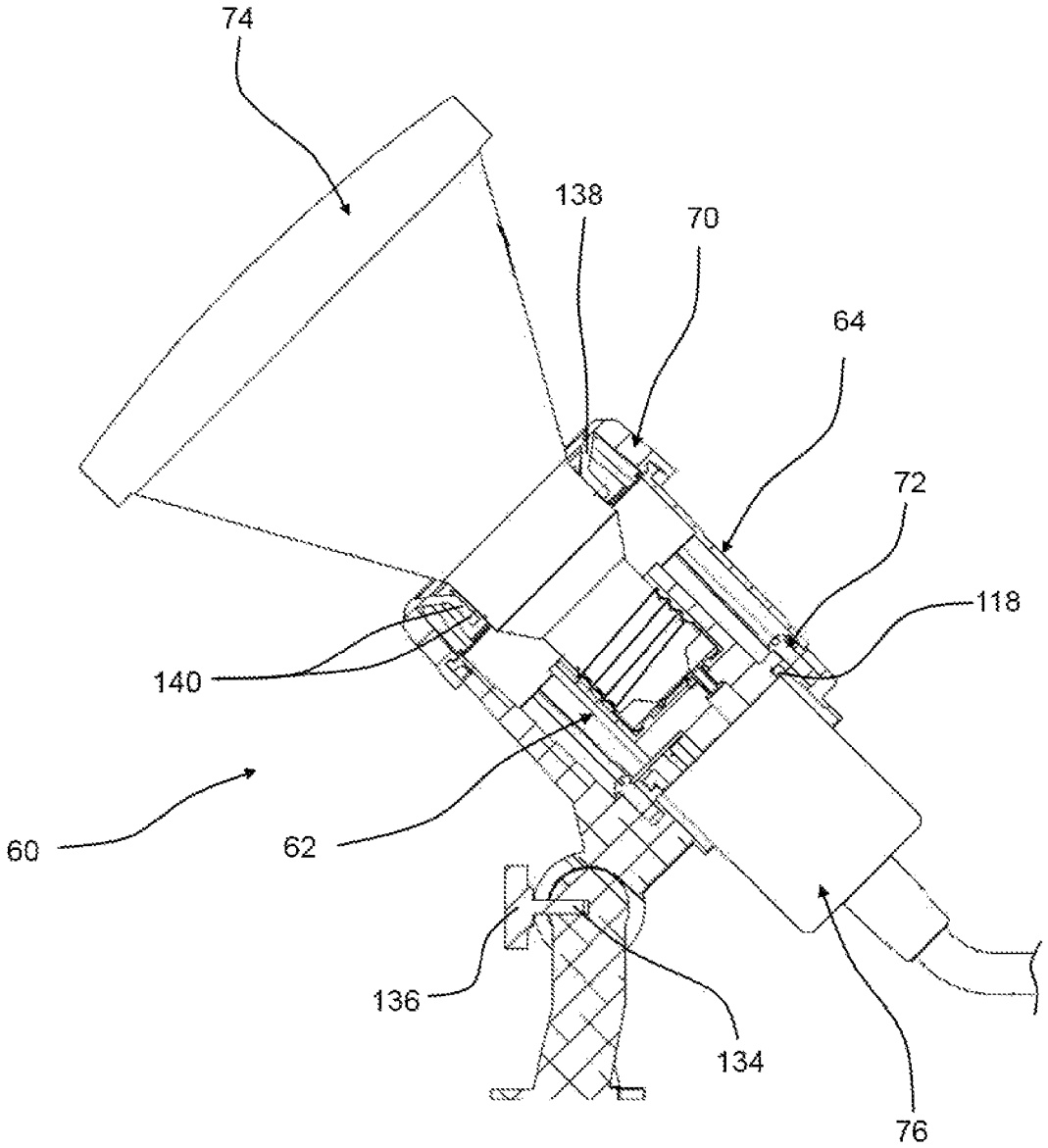
FIG. 16 is a sectional view of an assembled light fixture according to an exemplary embodiment of the invention.

The housing 64 includes a hub 128 that connects the housing 64 to the base 68. As best shown in FIGS. 11-13, the hub 128 is a substantially hollow-cylindrical body having a hub opening 130 positioned in the rear of the hub 128 and a hub slot 131 positioned in the front of the hub 128. The hub opening 130 and the hub slot 131 allow the hub 128 to pivotally connect to the base 68. As best shown in FIGS. 15 and 16, the hub slot 130 receives a shank 134 connected to a knob 136. The shank 134 extends through the hub slot 130 and engages the base 68 to hold the housing 64 in a set position relative to the base 68. The hub slot 130 and the shank 134 may have cooperating threads, and the knob 136 may be turned to bring the shank 134 into and out of engagement with the base 68. The hub 128 is depicted as pivotally connecting with a base 68 having a ground stake. In various alternative embodiments, the shape, size, and configuration of hub 128 may be altered to connect to different types of bases 68 or to provide a non-pivotal connection to the base 68.

The housing 64 may be a unitary structure of a single material or the various components of the housing 64 may be separately connected mechanically or via adhesive and/or formed from different materials. For example, the shroud 112 may be formed of a flexible, resilient, or elastomeric material while the remaining portions of the housing 64 may be metallic.

A bulb gasket 70 may be connected to the bulb receiving end 106 of the housing 64. The bulb gasket is designed to engage with a light bulb 74, for example with the lip 110, and form a seal which protects entry of water, dirt, or other harmful or corrosive elements into the first opening 108. As best shown in FIG. 16, the bulb gasket 70 has an inner ring 138 which engages the light bulb 74. One or more protrusions 140 may encircle the surface of the inner ring 138 to assist in forming a seal. The protrusions 140 are shown as v-shaped or knife-edge protrusions, although other shapes, such as rounded or flat, may also be used. The bulb gasket 70 is made from a resilient material, for example an elastomer.

The socket 62 and housing 64 shown in the figures and described herein utilize a threaded bulb. Other embodiments may comprise any other bulb or lamp couplings known in the art, including but not limited to straight pin connectors typically of the GU, G9, G4, or bayonet types, and the like. Another embodiment comprises alternative electrical couplings, such as but not limited to two hot blades typically used in 200-250 volt arrangement, such as the 6-15 type. Still other embodiments comprise locking-type couplings such as NEMA L6-20.

Operation

In operation, a gasket 66 is positioned in the gasket slot 104 and the socket 62 may be inserted into to the housing 64 with the mounting bosses 100A-C aligned with the depressions 120A-C. The mounting fasteners 72 are inserted through respective mounting apertures 102A-C and into the ring apertures 122A-C to secure the socket 62 to the housing 64. A fastener 72 may also be placed into the grounding tab 89 and into the ground aperture 124. When the socket 62 is secured in the housing 64, the prongs 84, 86, 88 extend into the second opening 114 and are at least partially surrounded by the shroud 112. In various embodiments, the shroud 112 may completely cover the prongs 84, 86, 88. A bulb gasket 70 may then be connected to the housing 64 around the first opening 108. The housing 64 may then be attached to a base 68 and a light bulb 74 is inserted through the bulb gasket 70 into the socket 62. The light fixture 60 may then be positioned in the ground. Once the light fixture is positioned, an extension cord 50 can be connected to the light fixture 60. The female plug 52 will be positioned at least partially in the second opening 114 and at least partially covered by the shroud 112, preventing water, dirt, or other elements from affecting the electrical connection. In various exemplary embodiments, the shroud may form a weatherproof or waterproof enclosure around the connection with the extension cord 50. The electrical connection is also elevated from the ground to prevent a hazard from pooling water.

The concepts disclosed are not limited to the specific implementations shown herein. For example, implementations of the light fixture components may be formed of any of many different types of materials or combinations thereof that can readily be formed into shaped objects provided that the materials selected are consistent with the intended operation of light fixture implementations. For example, the components may be formed of polymers such as thermoplastics (e.g. ABS, fluoropolymers, polyacetal, polyamide, polycarbonate, polyethylene, polypropylene of low or high density, polysulfone, and/or the like), thermosets (e.g. epoxy, phenolic resin, polyimide, polyurethane, silicone, and/or the like), composites and/or other like materials, metals and/or other like materials, alloys and/or other like materials, and/or any combination of the foregoing. Also, appropriate mounting fasteners, hardware and components may be provided. Those of ordinary skill in the art will readily be able to select appropriate materials and manufacture these products from the disclosures provided herein. Furthermore, the light fixture and any other components forming any particular implementation of a light fixture may be manufactured simultaneously or separately and joined with one another, while other components may be pre-manufactured or manufactured separately and then assembled with the integral components.

One particular benefit that may be found in particular implementations of light fixtures disclosed in this document is the value added from the reduced chance of electrocution and tripping of an electrical circuit to create a ground fault condition. Still further, the manufacturing costs and time may be reduced by decreasing the number of components and manufacturing steps without reducing the products functionality One or more of embodiments of the inventions disclosed herein relate to outdoor weatherproof lighting. In particular, some embodiments provide an economical way to illuminate landmarks in the dark. Embodiments may include but are not limited to a lamp-holder socket that can be directly attached to an extension cord and to a light bulb. Embodiments may also include a portable adjustable housing which, in conjunction with the lamp-holder socket, provides a safe, effective, and economical product for outdoor nighttime illumination.

Only those claims which use the words "means for" are to be interpreted under 35 U.S.C. 112, sixth paragraph.

What is claimed:

1. An outdoor light fixture comprising:

a housing having a first opening, a second opening, a shroud extending at least partially around said second opening, and a locating ring positioned between said first opening and said second opening; and a socket located in the housing and having an insulator, and a skirt for positioning said socket relative to said locating ring.

2. The outdoor light fixture of claim 1, further comprising a gasket located between said skirt and said locating ring.

3. The outdoor light fixture of claim 2, wherein said skirt includes a gasket slot receiving said gasket.

4. The light fixture of claim 1, wherein said shroud forms a weatherproof barrier when an electrical cord is inserted into said second opening.

5. The light fixture of claim 1, wherein said socket includes a set of prongs.

6. The light fixture of claim 1, wherein said socket includes a threaded screw shell for receiving a light bulb.

7. The light fixture of claim 1, wherein said skirt includes a mounting boss for connecting said socket to said locating ring.

8. The light fixture of claim 7, further comprising a fastener passing through said mounting boss and at least partially into said locating ring.

9. The light fixture of claim 1, further comprising a base component and wherein said housing is pivotally coupled to said base component.

10. An outdoor light fixture comprising:

a socket having an insulator and a skirt including a mounting boss; and a housing having a first opening, a second opening, a shroud extending at least partially around said second opening, and a depression at least partially receiving said mounting boss.

11. The outdoor light fixture of claim 10, further comprising a locating ring positioned between said first opening and said second opening.

12. The outdoor light fixture of claim 11, wherein said mounting boss includes a mounting aperture and said locating ring includes a ring aperture, and a fastener passes through said mounting aperture and at least partially into said ring aperture.

13. The outdoor light fixture of claim 10, wherein said housing tapers from said first opening to said second opening.

14. The outdoor light fixture of claim 10, wherein said socket includes a set of prongs.

15. The outdoor light fixture of claim 14, wherein said shroud at least partially covers said set of prongs.

16. An outdoor light fixture comprising:

a housing having a first opening, a second opening, a shroud extending at least partially around said second opening, and a locating ring positioned between said first opening and said second opening;

a socket located in the housing and having an insulator, a skirt, and a gasket slot; and a gasket positioned in said gasket slot forming a seal between said socket and said housing.

17. The outdoor light fixture of claim 16, wherein said gasket forms a seal between said socket and said locating ring.

18. The outdoor light fixture of claim 16, wherein said housing is a single-piece, unitary structure.

19. The outdoor light fixture of claim 16, wherein said skirt further comprises a mounting boss and said housing comprises a depression receiving said mounting boss.

20. The outdoor light fixture of claim 16, further comprising a bulb gasket connected to said housing.

* * * * *